US005720544A

United States Patent [19]

Shu

[11] Patent Number: 5,720,544

[45] Date of Patent: Feb. 24, 1998

[54] WATERPROOF LIGHT BULB HOLDER

[76] Inventor: Kuo Fen Shu, No. 10, Lane 198, Chung Cheng Road, Hsinchu, Taiwan

[21] Appl. No.: 714,613

[22] Filed: Sep. 16, 1996

[51] Int. Cl.[6] ..... F21V 31/00

[52] U.S. Cl. ..... 362/226; 362/267; 439/619; 439/699.2

[58] Field of Search ..... 362/226, 806, 362/396, 382, 267, 311, 353, 363; 439/699.2, 616, 617, 619

[56] References Cited

U.S. PATENT DOCUMENTS 4,807,098 2/1989 Ahroni ..... 362/806

4,935,852 6/1990 Hsu ..... 362/226

5,499,174 3/1996 Lin ..... 362/806

*Primary Examiner*—James C. Yeung

*Attorney, Agent, or Firm*—Morton J. Rosenberg; David I. Klein; Jun Y. Lee

[57] ABSTRACT

A waterproof light bulb holder is provided that includes a cap having a light bulb engaged in one end thereof, the cap and bulb being received within a bore formed in one end of a base. A plastic cork having two opened holes for receiving the electrical wires which are inserted into the base with conductors coupled thereto is disposed within a frustro-conically shaped bore found in an opposing end of the base. The plastic cork provides a secure and waterproof engagement with both the base and the wires, to prevent water from infiltrating into the base and resulting in a short circuit.

1 Claim, 3 Drawing Sheets

WATERPROOF LIGHT BULB HOLDER

BACKGROUND OF THE INVENTION

Usually, a light string is used outdoors and is often subject to rain. Sometimes, water infiltrates into the base. If water stays inside the base, it may corrode the conductors or result in a short circuit. The light string will thereby be damaged, and it disturbs users to check and replace the broken one. So it is important to find a waterproof light bulb holder for use in outdoor light strings.

SUMMARY OF THE INVENTION

In view of the above drawback, the primary object of the present invention is to provide an improved cap and base structure which can prevent water from infiltrating into the base and prevent a short circuit from resulting, eliminating the drawback of the said prior systems.

BRIEF DESCRIPTION OF THE ACCOMPANYING DRAWINGS

DETAILED DESCRIPTION OF THE EMBODIMENTS

Figure 1:
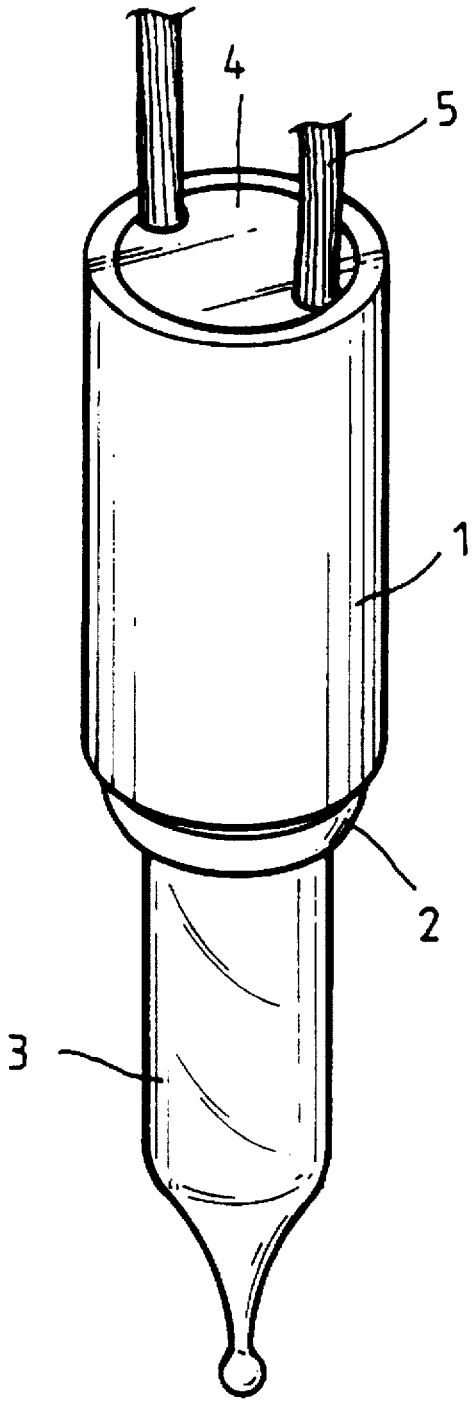
FIG. 1 is a perspective view showing an embodiment of the invention.
Figure 2:
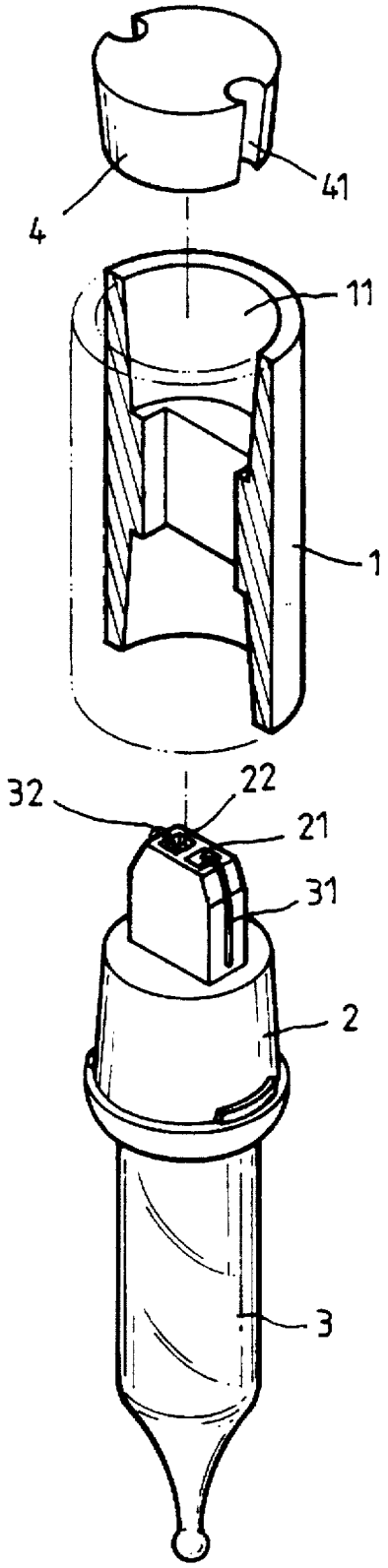
FIG. 2 is an exploded perspective view of the embodiment according to the invention; and, FIG. 3 is a cross-sectional view of the embodiment according to the invention.
Figure 3:
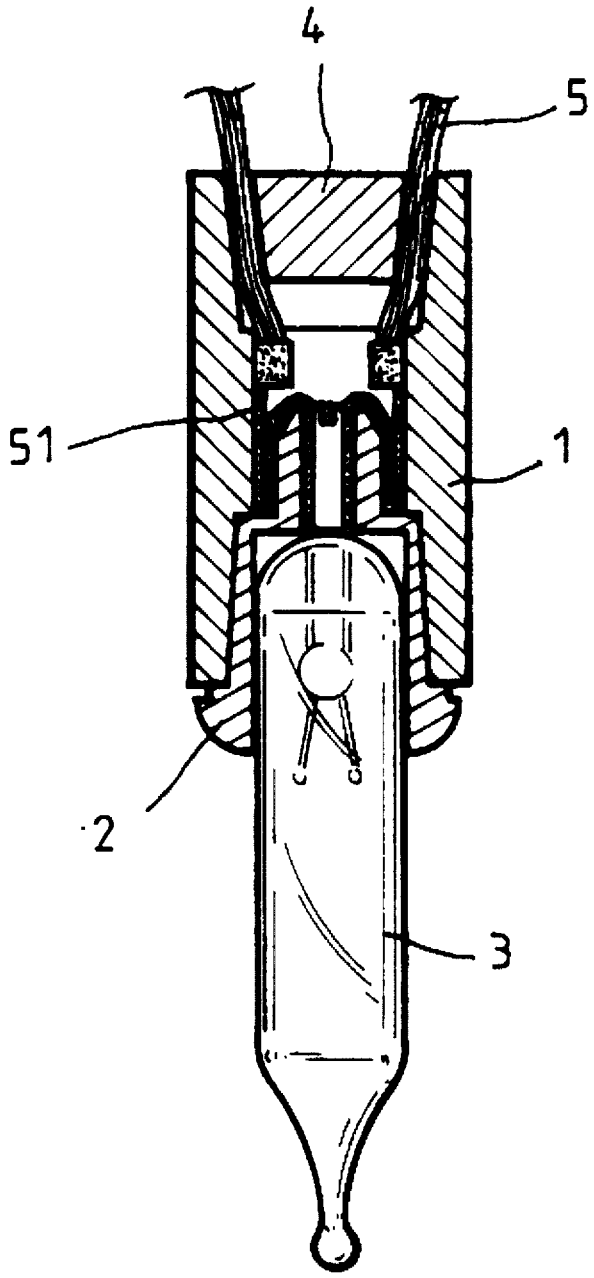

Referring to FIGS. 1 to 3, there are shown the light bulb holder including a base 1, a cap 2, and a light bulb 3. The bulb 3 is connected within the cap 2 while two conducting wires 31, 32 of the bulb 3 pass through a pair of holes 21, 22 formed on the end of the cap 2, like that of a prior known light bulb structure. The characteristics of the present invention are to provide a frustro-conically shaped bore 11 formed at one end of the base 1 while the other end of the base 1 engages the cap 2 as well as the bulb 3 thereinside. The wires 5 connect with conductors 51 disposed within the bore 11 and contact the two conducting wires 31, 32 respectively. A plastic cork 4 having two opened holes 41 is capable of being placed in the bore 11 and has a frustro-conical contour for providing a secure engagement within bore 11, and the wires 5 are received in the two holes 41. Because of the secure engagement between the cork 4, the base 1, and the wires 5, water or rain will never infiltrate into the base. Thus, the light bulb holder according to the present invention provides an excellent waterproof effect.

According to above structure of this invention, rain will not come into the base i and no water will then come in contact with the two conductors or the two conducting wires. It can be obviously understood that a short circuit is thereby prevented.

I claim:

1. A waterproof light bulb holder, comprising:

a cap having an open first end for receiving a light bulb therein, said cap having an opposing closed second end with a pair of through openings formed therein for respective passage of a pair of leads of the light bulb therethrough;

a base having a first bore formed in a first end thereof for receiving said second end of said cap therein, said base having a second bore formed in an opposing second end thereof, said second bore having a frustro-conical contour; and a plastic cork having a frustro-conical contour for being sealingly engaging said base within said second bore, said plastic cork having a pair of openings formed therein and adapted to tightly engage a respective pair of wires extending into said base.

* * * * *